United States Patent [19]

Laempe

[11] Patent Number: 4,798,471

[45] Date of Patent: Jan. 17, 1989

[54] APPARATUS FOR MAKING MOLDING SAND

[76] Inventor: Joachim Laempe, Gewerbegebiet Grienmatt, D-7860 Schopfheim, Fed. Rep. of Germany

[21] Appl. No.: 51,717

[22] Filed: May 18, 1987

[30] Foreign Application Priority Data

May 20, 1986 [DE] Fed. Rep. of Germany ..... 3616894

[51] Int. Cl.[4] ..... B28C 5/08

[52] U.S. Cl. ..... 366/65; 366/244; 366/101; 366/138; 366/255; 366/332; 366/289; 366/177

[58] Field of Search ..... 384/12; 366/65, 64, 366/33, 42, 37, 78, 77, 98, 138, 177, 189, 193, 194, 332, 289, 279, 180, 199, 208, 239, 240, 285, 286, 184, 241, 242, 244, 255, 256, 150, 181, 341, 101; 15/304; 222/361, 362, 162

[56] References Cited

U.S. PATENT DOCUMENTS

| | | | |
|---|---|---|---|
| 542,669 | 7/1895 | Winterbotham | 15/304 |
| 722,310 | 2/1903 | Lapp | 366/177 |
| 2,588,591 | 4/1952 | Thompson | 366/289 |
| 2,651,343 | 9/1953 | Alexander | 366/289 |
| 3,044,750 | 7/1962 | Schmitt, Jr. | 366/316 |
| 3,106,947 | 10/1963 | Logan | 222/361 |
| 3,638,917 | 2/1972 | Osten | 366/316 |
| 3,822,737 | 7/1974 | Edwards | 366/192 |
| 4,159,028 | 6/1979 | Barker et al. | 366/150 |
| 4,169,681 | 10/1979 | Kato | 366/255 |
| 4,404,168 | 9/1983 | Baumberger | 366/150 |
| 4,653,408 | 3/1987 | Nagishima | 384/12 |

*Primary Examiner*—Robert W. Jenkins
*Assistant Examiner*—J. Dwight Poffenberger, Jr.
*Attorney, Agent, or Firm*—Peter K. Kontler

[57] ABSTRACT

Apparatus for making molding sand has one or more housings defining upright cylindrical chambers and being movable with reference to a plate-like support to and from positions of register with an aperture in the support. Each chamber is normally closed at its upper end by a closure which has outlets for sand and one or more binder materials (such as clayey matter, pulverulent iron oxide, pulverized wood and/or others), and a rotary propeller is movable axially in each chamber to mix the ingredients in the circumferential direction as well as axially of the respective chamber.

47 Claims, 4 Drawing Sheets

APPARATUS FOR MAKING MOLDING SAND

BACKGROUND OF THE INVENTION

The invention relates to apparatus for mixing sand with one or more binder materials to form molding sand which can be used in casting machines for the making of cores or as a material for filling portions of molding boxes.

It is known to mix sand with one or more liquid and one or more solid binder materials so as to impart to the resulting molding sand a desirable consistency which is required in a casting or molding machine. The binder material can include one or more clayey substances, water, and/or flowable solid materials such as powdered wood, pulverulent iron oxide and/or others. As a rule, metered quantities of sand and of the constituents of binder material are introduced into a mixing chamber and the contents of the mixing chamber are thereupon mixed in order to convert them into a batch of molding sand which is ready for use in a casting machine. As a rule, the means for mixing includes a tool which is rotatable in the mixing chamber within a housing for metered quantities of sand and binder material, and the tool converts the contents of the chamber into a more or less homogeneous mixture constituting a batch of molding sand.

Heretofore known apparatus for producing molding sand, especially for the making of cores, are known as charge mixers, vibratory mixers or continuous (through flow) mixers.

A conventional charge mixer which is designed to make successive batches of molding sand is provided with a round housing wherein the height of the cylindrical chamber in the housing equals or exceeds the inner diameter of the housing. The bottom portion of the chamber contains a slowly rotating propeller which mixes the contents, primarily sand which is admitted in metered quantities. As a rule, the metering means comprises a scale or another suitable weighing device which determines the amount of sand to be admitted into the chamber prior to start of a batch- or charge-forming operation. Alternatively, sand can be admitted first into a vessel which is thereupon evacuated by dumping its contents into the housing of the charge-forming apparatus. A drawback of such apparatus is that the output is low and that they occupy a substantial amount of space, especially for the device or devices which are used for metering of sand and binder material. The metering device or devices are normally disposed at a level above the housing so that the overall height of such apparatus is often excessive. This holds especially true if, as is customary, the apparatus is disposed directly above a casting machine in which freshly formed batches of molding sand are put to use.

The mode of operation of the just described apparatus is such that a metered quantity of sand is admitted into the housing in a first step, and metered quantities of binder material are admitted thereafter on top of the metered quantity of sand. Such mode of operation cannot ensure a thorough intermixing of sand with all binder materials and, in addition, it takes a long time to convert the layers of superimposed constituents into a substantially homogeneous mixture which is ready to be admitted into a casting machine.

An additional drawback of such apparatus is that they cannot be readily cleaned upon the making of a batch. The housing is provided with a lateral door by way of which the batch of freshly formed molding sand is evacuated. It is unavoidable that a certain amount of molding sand will remain at the bottom of the housing as well as that particles of molding sand will adhere to the internal surfaces of the housing. The remnants of molding sand harden in the housing within a relatively short interval of time, normally within approximately 30 minutes. This interferes with the action of the mixing tool and reduces the effective volume of the housing. Moreover, remnants of molding sand in the housing can distort the composition of the next batch.

A conventional apparatus which employs a vibratory housing resembles the just discussed charge forming apparatus except that the mixing tool is replaced with a device which vibrates the entire housing. The metering devices are located at a level above the vibrating housing. The dimensions of such apparatus are rather small in order to ensure that oscillation of the housing will result in the making of a homogeneous batch of molding sand. Accordingly, the output of such apparatus is relatively low. In addition, large amounts of energy are required to agitate the entire housing. The quality of molding sand which is obtained in such apparatus is particularly unsatisfactory when the molding sand is to contain powdery binder material of low specific weight.

Continuous mixing apparatus employ a rotary feed screw which conveys sand and binder material through a housing. A drawback of such apparatus is that the groove or grooves of the feed screw are continuously filled with sand and binder material so that the feed screw necessitates frequent cleaning in order to prevent setting of molding sand in its groove or grooves. The cleaning operation must take place prior to admission of a fresh batch of sand and binder material in order to prevent changes in the composition of the freshly formed mixture. It is necessary to remove the feed screw from the housing at least once a week and to introduce it into a furnace in order to burn away hardened remnants of molding sand. The wear upon the feed screw and upon other parts of such apparatus is very pronounced, and the initial and maintenance costs are high.

German Auslegeschrift No. 1,284,946 of Hägele et al. discloses a mixer wherein a rotary vessel receives a main mixing unit and an auxiliary mixing unit. The latter is mounted on a support which serves to lift it out of the vessel or to lower it back into the interior of the vessel. The auxiliary mixing unit is used for preliminary intermixing of the contents of the vessel and is thereupon lifted out of the vessel prior to start of final mixing by the main mixing unit.

German Auslegeschrift No. 1,482,475 of Ronceray discloses a friction type mixer with a fixed vessel wherein mixing or grinding rollers are mounted on a vertically movable support for a stripping device in such a way that the rolls are lifted out of the vessel when the stripping device descends into the vessel and vice versa. The stripping device serves to promote evacuation of the mixture from the vessel by way of one or more bottom openings.

German Offenlegungsschrift No. 2,215,887 of Edwards discloses an apparatus wherein the mixing chamber receives a first charge of sand and binder material and a second charge of sand and a catalyst. The two charges are intermixed prior to admission by gravity feed into a core former or a molding box. The mixing chamber is cleaned upon completed evacuation of its contents

OBJECTS AND SUMMARY OF THE INVENTION

An object of the invention is to provide a novel and improved apparatus which can rapidly mix metered quantities of sand and binder material to form batches of molding sand in a time-saving operation and at a reasonable cost.

Another object of the invention is to provide an apparatus which can furnish batches of molding sand at frequent intervals and which is capable of making highly homogeneous batches of molding sand.

A further object of the invention is to provide the apparatus with novel and improved means for facilitating rapid and thorough cleaning of the mixing chamber or chambers Still another object of the invention is to provide an apparatus wherein the composition of a fresh batch cannot be influenced by remnants of the previously formed batch or batches of molding sand.

A further object of the invention is to provide the apparatus with novel and improved means for facilitating rapid and complete evacuation of successive batches of molding sand.

An additional object of the invention is to provide novel and improved means for mixing the constituents of molding sand in the mixing chamber or chambers.

Another object of the invention is to provide the apparatus with novel and improved means for manipulating the movable constituents of the apparatus in a time-saving manner and by ensuring complete evacuation of batches of molding sand directly into one or more casting machines.

Another object of the invention is to provide a novel and improved method of making batches of molding sand.

A further object of the invention is to provide a novel and improved casting machine which employs one or more apparatus of the above outlined character.

The invention is embodied in an apparatus which is used to mix sand with flowable binder material (such as clayey matter, pulverized wood, pulverulent iron oxide and/or others) for the making of molding sand The apparatus comprises a housing which defines a preferably cylindrical mixing chamber, means for admitting into the chamber metered quantities of sand and binder material (the binder material normally includes solid and liquid constituents), and means for mixing the contents of the chamber The mixing means comprises at least one mixing tool which is operative to mix the contents at least substantially over the entire cross-section of the chamber, and means for moving the mixing tool at least once in the axial direction of the chamber It is often preferred to repeatedly move the mixing tool back and forth in the axial direction of the mixing chamber. The mixing means preferably comprises means for rotating the mixing tool (e.g., about the axis of the chamber) while the tool is being moved in the axial direction of the chamber so that a mixing of successive strata of the contents of the chamber (in different planes extending at right angles to the axis of the chamber) takes place simultaneously with a mixing in the axial direction of the chamber The axis of the chamber is or can be substantially vertical, and the length of the mixing tool in the axial direction of the chamber is preferably less or much less than the axial length of the chamber The axial length of the chamber preferably equals or exceeds the diameter of the chamber.

The housing is preferably provided with a detachable closure or lid for the chamber, and the means for admitting sand and binder material preferably includes outlets in the closure so that the ingredients of the mixture which is to be formed in the housing enter the chamber by way of the closure. If the axis of the chamber is vertical or nearly vertical, the closure is disposed above the chamber.

The admitting means preferably comprises means for admitting sand simultaneously with binder material. The outlets of the admitting means are preferably spaced apart from each other in the circumferential direction of the chamber, and such outlets are preferably arranged to admit sand and binder material in substantial parallelism with the axis of the chamber. The means for admitting binder material can comprise at least one nozzle for admission of one or more jets of binder material into the chamber. The nozzle can constitute a spray nozzle which spreads the admitted material across the chamber in the housing.

The tool preferably constitutes or comprises a propeller with one or more blades.

The chamber is preferably provided with an open lower end which constitutes an outlet of the housing, and the apparatus preferably further comprises a support (e.g., a horizontal plate) for the housing. The support has an aperture, and the housing is movable with reference to the support between at least one first position in which the support at least substantially seals the lower end of the chamber and a second position in which the lower end of the chamber registers with the aperture so that the thoroughly intermixed contents of the chamber can be evacuated from the housing by way of the lower end of the chamber and by way of the aperture in the support The area of the aperture can equal or even exceed the area of the lower end of the chamber in order to allow for convenient and rapid evacuation of the contents of the chamber The area of the lower end of the chamber preferably matches the area of any other part of the chamber; this, too, contributes to convenience of evacuation of the contents of the chamber and facilitates cleaning of the surface which surrounds the chamber The apparatus can supply molding sand directly to a casting machine and, to this end, the aperture of the support is preferably disposed at a level above such machine so that the evacuated contents of the chamber can enter directly a molding box The support can carry one or more additional housings which are movable with reference thereto so that the open lower ends of their mixing chambers can be moved to and from positions of register with the aperture Alternatively, the support can be provided with at least one additional aperture if molding sand is to be supplied to two or more discrete casing machines The upper end of the preferably vertical or upright chamber is open to constitute an inlet for admission of sand and binder material, and the admitting means is then disposed at a level above the upper end of the chamber. Such apparatus can comprise elevator means for lifting and lowering the admitting means with reference to the housing so that the admitting means can be lifted preparatory to movement of the housing to the second position. The elevator means can comprise a plate-like or otherwise configurated carrier for the mixing tool and for the admitting means, and motor means for moving the carrier up and down. The means for rotating the blade or blades of a rotary mixing tool is preferably mounted on the carrier for the admitting means The carrier is movable along suitable guide means (e.g., two or more upright columns), and the means for moving the carrier up and down can comprise one or more linear motors (e.g., one or more double-acting fluid-operated cylinder and piston units) which reciprocate the carrier along its guide means The guide means is or can be designed in such a way that the carrier is confined to reciprocatory movements in parallelism with the axis of the mixing chamber.

Instead of using the support as a means for sealing or closing the open lower end of the chamber in the first position or positions of the housing, the apparatus can comprise a gate movable between a first position in which it seals or nearly seals the lower end of the chamber and a second position in which the gate permits evacuation of the contents of the housing by way of the lower end of the chamber Such gate can be mounted between the support and the housing and is moved to its second position when the lower end of the chamber registers with the aperture of the support.

The closure for the inlet of the housing (i.e., for the upper end of the chamber if the axis of the chamber is substantially vertical) can be mounted on a holder which further carries means for moving the closure up and down between a first position in which the closure overlies the chamber and is biased against the housing and a second position in which the closure is spaced apart from the chamber. The housing can be moved between its first and second positions while the closure is held in raised position, i.e., the closure need not share the movements of the housing to and from the second position but remains in a position such that it can be lowered onto or into the housing when the latter reassumes its first position The means for moving the housing with reference to the holder for the closure can include a pusher or the like which is actuated by a linear motor (e.g., a double-acting fluid-operated cylinder and piston unit), and the apparatus preferably comprises guide means for the housing. The holder can be provided with arms which are mounted on such guide means at opposite sides of the path of movement of the housing with reference to the support The pusher of the means for moving the housing can be configurated in such a way that it at least partially surrounds the open lower end of the chamber.

The apparatus preferably further comprises means for cleaning the chamber. The cleaning means is preferably mounted in such a way that it can clean the chamber in the second position of the housing, i.e., when the open lower end of the chamber registers with the aperture of the support The cleaning means can comprise at least one cleaning implement and means for moving the cleaning implement axially of the chamber into and from the inlet of the housing. Thus, if the axis of the chamber is vertical, the cleaning implement is movable from an idle or inoperative position at a level above the housing into and from the chamber by respectively moving downwardly and upwardly. The arrangement is preferably such that the cleaning implement is movable downwardly into the chamber while the lower end of the chamber is in register with the aperture of the support.

The cleaning implement can have a diameter which equals or approximates the diameter of the chamber. The means for moving the cleaning implement with reference to the housing is preferably mounted on or is movable with the means for moving the mixing tool axially of the chamber. The cleaning means can be mounted on the carrier for the closure and for the admitting means so that the cleaning means need not share the movements of the housing between its first and second positions. The distance which the housing covers on its way between the first and second positions preferably equals the distance between the cleaning means and the mixing tool.

The cleaning implement can comprise two spaced-apart walls (at least one of these walls can constitute or comprise a disc) which define a plenum chamber, and such cleaning means further comprises a source of pressurized gaseous fluid (normally a source of compressed air) and means for conveying the fluid from the source to the plenum chamber so that the latter can discharge pressurized fluid against the internal surface of the housing around the chamber while the cleaning implement moves axially of the chamber in the interior of the housing to remove particles of sand and other impurities from the internal surface of the housing. To this end, the plenum chamber is open (at one or more locations) along the internal surface of the housing, at least while the implement is caused to move in the housing in the axial direction of the chamber. The conveying means can comprise an elongated hollow shaft or shank which carries the walls of the cleaning implement. The shank forms part of the means for moving the implement with reference to the housing One wall of the implement is nearer to the open lower end of the chamber in the housing than the other wall, and the other wall preferably includes or constitutes a plunger which is in sealing (frictional) engagement with the internal surface of the housing during movement of the cleaning implement in the chamber of the housing This ensures predictable removal of impurities from the internal surface of the housing The cleaning implement can be mounted on the carrier for the mixing tool in such a way that it is in register with the chamber of the housing when the latter is moved to its second position in which the open lower end of the chamber in the housing is in register with the aperture of the support The means for securing the cleaning means to the carrier can comprise one or more brackets or the like.

The housing can be provided with a flange which surrounds the open lower end of the chamber therein, and the underside of such flange can be formed with an arcuate or circumferentially complete groove. The flange has means for admitting into the groove a pressurized fluid (e.g., compressed air) so that the fluid which leaks from the groove reduces friction between the support and the housing when the latter is moved from its first to its second position and vice versa. The means for admitting pressurized fluid into the groove can comprise one or more ports which are provided in the upper side and/or in another surface of the flange and communicate with the groove.

The novel features which are considered as characteristic of the invention are set forth in particular in the appended claims The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
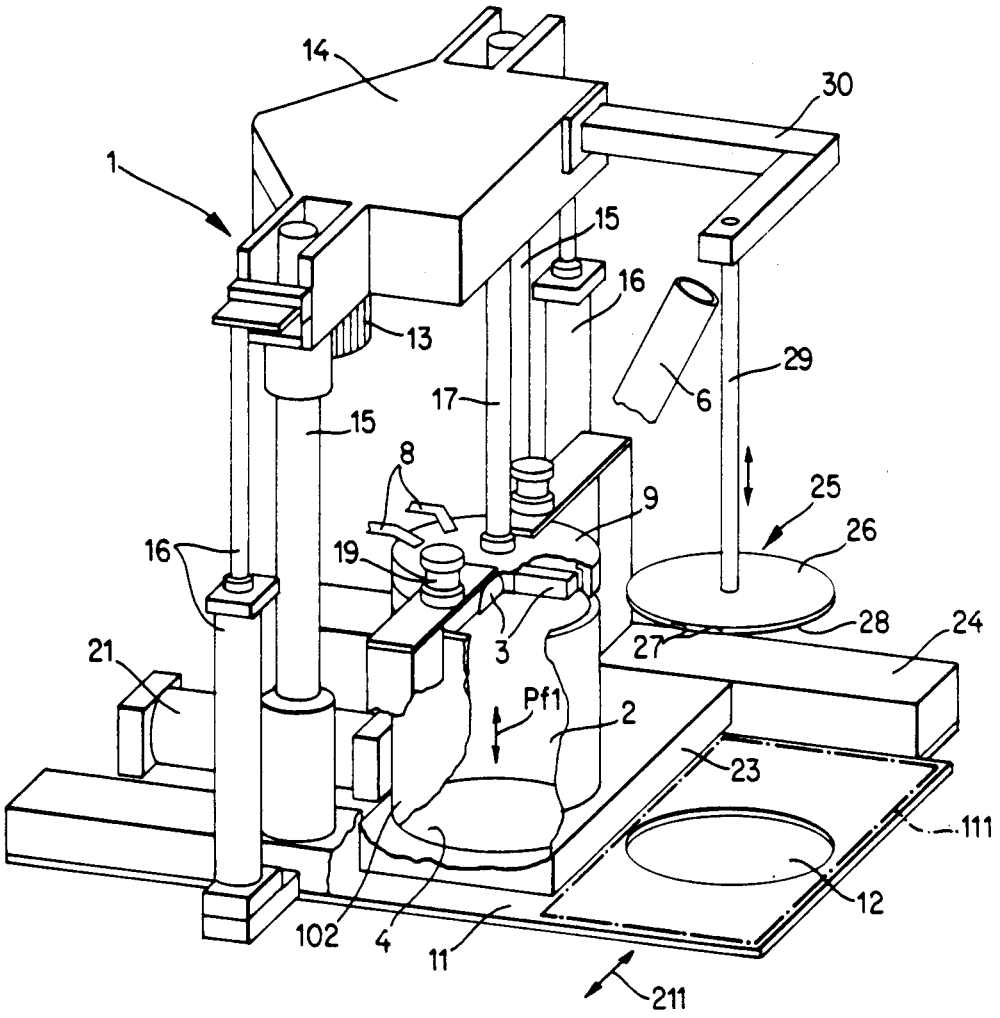
FIG. 1 is a perspective view of an apparatus which embodies one form of the invention and has a single housing shown in a position in which the lower end of its chamber is closed by the support, the closure for the upper end of the chamber being shown in raised position.

The apparatus 1 which is shown in FIGS. 1–5 and 7 serves to mix sand with one or more liquid and with one or more solid binder materials to form molding sand. Solid binder materials can include pulverulent wood, iron oxide powder and/or others Liquid binder material can include a clayey substance. The mixture can be admitted directly into a casting machine CM (e.g., a mold or core shooter) a portion of which is shown in the lower part of FIG. 2. The mixture can be used to make cores or molds in molding boxes of conventional design, not shown.

The apparatus 1 comprises a housing 102 which defines an upright cylindrical chamber 2 having an open lower end or outlet 4 and an open upper end or inlet. The means for admitting metered quantities of sand and binder material into the chamber 2 comprises a plurality of conduits 6 and 8 (see particularly FIG. 3) having outlets 5 (conduits 6) for admission of sand and outlets 7 (conduits 8) for admission of several binder materials. The outlets 5 and 7 are preferably distributed along the circumference of the chamber 2 so that each thereof can admit a column of respective material into the housing 102. This is shown schematically in FIGS. 3 and 4.

The means for mixing metered quantities of sand and binder material which are admitted into the chamber 2 includes one, two or more rotary mixing tools (the drawing shows a single rotary mixing tool 3) which are rotatable about the vertical axis of the chamber 2 and which are further movable axially between the upper and lower ends of the chamber so as to effect a thorough intermixing of metered quantities of sand and binder material in the circumferential direction as well as axially of the chamber 2. The illustrated mixing tool 3 is a propeller-like rotor having four equidistant radially extending blades. The directions in which the mixing tool 3 is reciprocable while it rotates about the axis of the chamber 2 in the interior of the housing 102 are indicated by a double-headed arrow Pfl. The arrangement is such that the mixing tool 3 rotates about the vertical axis of the chamber 2 while it moves axially in directions indicated by the arrow Pf1 so as to ensure that mixing of the constituents of the chamber 2 takes place simultaneously in the circumferential as well as in the axial direction of the housing 102. Such mixing in the circumferential and axial directions of the housing 102 ensures that the constituents of metered quantities of sand and binder material which are admitted into the chamber 2 by way of outlets 5 and 7 are intimately intermixed before the resulting batch of molding sand is discharged from the housing 102 by way of the open lower end 4 of the chamber 2. It is preferred to repeatedly move the mixing tool 3 up and down while the tool rotates about its vertical axis so as to guarantee the making of a batch of molding sand which is ready for admission into the casting machine CM and contains a highly homogeneous mixture of sand and one or more liquid and solid binder materials.

It is presently preferred to mount the housing 102 in such a way that the axis of its chamber 2 is vertical. However, it is equally within the purview of the invention to employ a housing which defines a horizontal or otherwise inclined chamber. The utilization of a housing 102 with a cylindrical chamber having a vertical axis is preferred at this time.

The axial length of the mixing tool 3 is a small fraction of the axial length of the chamber 2. This ensures that the rotating tool 3 mixes successive strata of the contents of the housing 102 while it moves axially between the upper and lower ends of the chamber 2. The diameter of the chamber 2 preferably equals or is less than its axial length (this can be readily seen in FIG. 2). The diameter of the mixing tool 3 is only slightly less than the diameter of the chamber 2.

It is also possible to utilize a mixing tool having an axial length which equals or even exceeds the axial length of the chamber 2. However, this would necessitate that a portion of the rotating and axially moving tool invariably project beyond one or the other axial end of the chamber. It is preferred to employ a mixing tool having an axial length which is a fraction of the axial length of the chamber 2 because this renders it possible to seal or substantially seal both axial ends of the chamber while it contains a batch of material including sand and one or more binder materials which are to be thoroughly intermixed in order to form a batch of molding sand. The utilization of a relatively short mixing tool is preferred on the additional ground that such tool can be rotated and moved axially with the exertion of a relatively small force, i.e., the means for rotating the mixing tool consumes relatively small amounts of energy. In addition, such relatively short tool has been found to be capable of thoroughly intermixing sand with one or more binder materials so as to form a homogeneous mixture which is ready to be admitted into the casting machine CM.

The lower end portions of the conduit 6 (for the admission of sand) and of the conduits 8 (for admission of binder materials) are connected to a cylindrical disc-shaped closure 9 which is used to close and preferably seal the upper end of the chamber 2 (i.e., the inlet of the housing 102) in the course of a mixing operation. The means for admitting metered quantities of sand into the conduit 6 and metered quantities of binder material into the respective conduits 8 is not specifically shown in the drawing. Such metering means can comprise scales and conveyors which transport metered quantities of material from the respective scales into the inlets of the corresponding conduits 6 and 8. The metering action can be automated to any desired extent. The arrangement is preferably such that the conduit 6 admits sand simultaneously with admission of binder material by way of the respective conduit or conduits 8. The metered quantity of sand which enters the chamber 2 forms a column surrounding the columns of binder material which is admitted by way of the respective conduits 8. This is shown schematically in FIGS. 3 and 4. It will be seen that the outlets 7 of the conduits 8 admit into the chamber 2 vertical columns of the respective binder material, and these columns are surrounded by sand which is admitted by way of the outlet 5 of the conduit 6. Such mode of admitting sand and binder material has been found to be particularly satisfactory for thorough intermixing by the blades or wings of the mixing tool 3 while the tool rotates about its own vertical axis which coincides with the axis of the chamber 2 and simultaneously moves up and down between the lower end 4 of the chamber and the closure 9 which is then maintained in sealing position and bears against the upper end of the housing 102 or against the upper side of the mass of flowable material in the chamber 2. As mentioned above, the blades or wings of the mixing tool 3 serve to intermix the contents of the chamber 2 at different levels above the lower end 4 of the chamber while simultaneously bringing about a highly desirable and satisfactory mixing action in the axial direction of the chamber, namely in directions indicated by the arrow Pfl.

Figure 3:
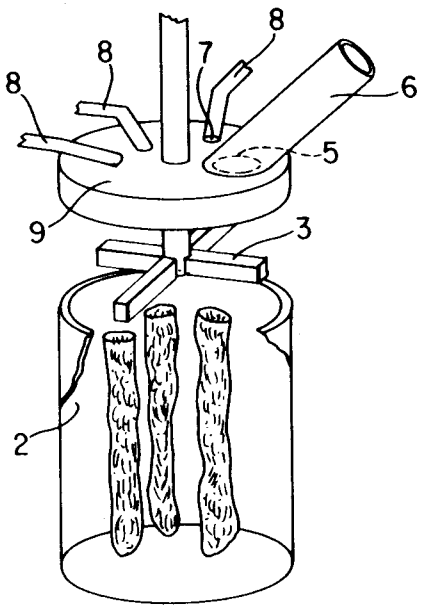
FIG. 3 is a perspective view of the housing and of the cover, with a portion of the housing broken away and further showing columns of binder material in the mixing chamber of the housing.
Figure 4:
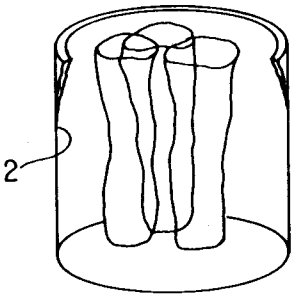
FIG. 4 is a fragmentary perspective view of the housing and of columns of binder material in its mixing chamber.
Figure 5:
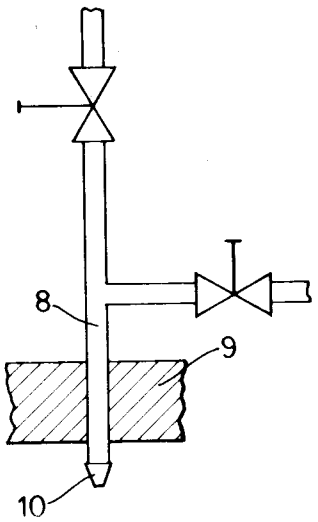
FIG. 5 is an enlarged fragmentary sectional view of the closure for the upper end of the chamber and of a nozzle which is used to spread binder material in the mixing chamber.

FIG. 5 shows that at least one of the conduits 8 can extend downwardly beyond the underside of the closure 9 and carries a nozzle 10 (for example, a spray nozzle) which discharges a single jet or several jets of respective binder material into the chamber 2. The arrangement may be such that the nozzle 10 sprays the respective binder material across the entire chamber 2. The non-referenced valves which are shown in FIG. 5 can be operated by remote control to admit metered quantities of one or more binder materials into that portion of the conduit 8 which carries the nozzle 10. If desired, at least a portion of each of the conduits 6 and 8 can be made of a flexible material so as to allow for movability of the closure 9 with reference to the housing 2 while the upper end portions of the conduits remain stationary. The nozzle 10 can be used to spray a liquid binder material onto the mass of sand and other binder material in the chamber 2. The spraying of a liquid and/or solid constituent of binder material across the entire chamber 2 promotes the mixing of constituents in the housing 102 and facilitates the task of the mixing tool 3. A liquid binder material or a solid pulverulent binder material which is discharged by the nozzle 10 can penetrate into sand which is admitted by way of the conduit 6 so that the housing 102 contains a mixture even before the tool 3 is set in rotary motion and before it begins to move up and down in the interior of the chamber 2. It is clear that each of the conduits 8 which are shown in FIG. 3 can be provided with a nozzle 10 or with a similar or equivalent device for spraying or distributing the respective binder material in the chamber 2.

Figure 2:
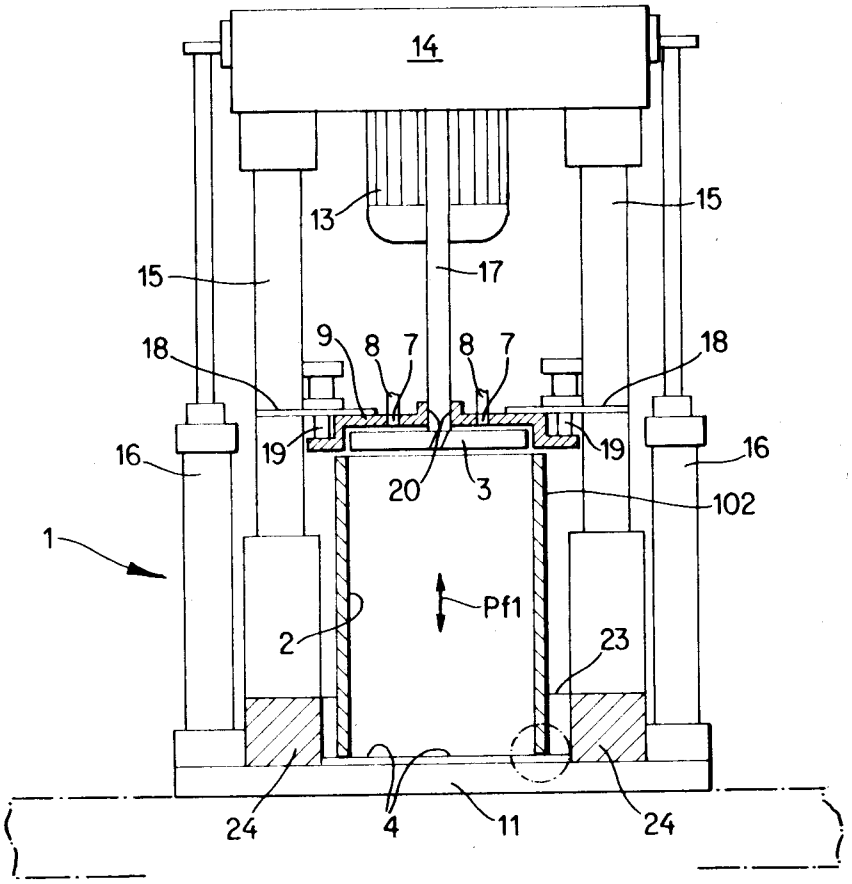
FIG. 2 is a front elevational view of the apparatus, with the housing and the closure shown in section.

If it is desired to ensure that the material which is discharged from the chamber 2 constitutes an intimate and highly homogeneous mixture of sand and one or more binder materials, the means for mixing the contents of the housing 102 can comprise two or more propeller-like mixing tools which are rotatable with and/or relative to each other and are disposed at different levels in the interior of the housing 102 when the mixing of the contents of the chamber 2 takes place FIGS. 1 and 2 show that the diameter of the open lower end 4 of the chamber 2 equals the diameter of each portion of the chamber, i.e., that the diameter of the internal surface of the housing 102 around the chamber 2 is constant all the way from the open upper end to the open lower end of the housing. This is desirable and advantageous because it allows for more convenient and predictable as well as rapid evacuation of batches of molding sand from the housing 102 as well as for predictable and rapid as well as thorough cleaning of the housing 102 prior to admission of a fresh supply of sand and binder material. The cleaning can take place after evacuation of each batch of molding sand or at required intervals following the making of two or more successive batches of molding sand. The internal surface of the housing 102 is preferably smooth so as to further reduce the likelihood of adherence of particles of sand and/or binder material to the housing This also simplifies the operation of a cleaning device 25 for the housing 102.

The apparatus 1 which is shown in FIGS. 1-5 and 7 has a plate-like horizontal support 11 with a circular aperture 12. The housing 102 rests on the support 11 and is movable with reference thereto between at least one first position (shown in FIG. 1) in which the upper side of the support 11 seals or at least nearly seals the open lower end 4 of the chamber 2, and a second position in which the lower end 4 of the chamber 2 registers with the aperture 12 so that a batch of molding sand can be evacuated by way of the lower end 4 and aperture 12 directly into the casting machine CM. The exact construction of the casting machine CM forms no part of the present invention. Such machine can constitute any one of a wide variety of presently known and utilized casting or molding machines The diameter of the preferably circular aperture 12 equals or even exceeds the diameter of the open lower end 4 of the chamber 2 so as to ensure that the support 11 cannot interfere with evacuation of a freshly formed batch of molding sand as soon as the housing 102 is caused to assume its second position. The means for moving the housing 102 relative to the support 11 comprises a linear motor 21 which can include one or more double-acting fluid-operated cylinder and piston units. The illustrated motor 21 has a pusher 23 which surrounds a portion of or the entire housing 102 at a level above the lower end 4 of the chamber 2 and is movable along horizontal guide members 24 provided therefor at the upper side of the support 11.

It is clear that it is also possible to move the support 11 relative to the housing 102, i.e., to move the aperture 12 toward and away from a position of register with the open lower end 4 of the chamber 2 prior to evacuation of a freshly formed batch of molding sand. It is presently preferred to mount the housing 102 for movement with reference to the upper side of the support 11. Complete evacuation of each freshly formed batch of molding sand from the chamber 2 is desirable and advantageous on the additional ground that eventual remnants of previously formed batch of molding sand cannot affect the composition of the next-following batch in the housing 102.

It is further possible to modify the apparatus 1 in such a way that the open lower end 4 of the chamber 2 in the housing 102 is normally closed and sealed by a reciprocable gate 111 (indicated in FIG. 1 by phantom lines) which normally overlies the aperture 12 and is movable with reference to the support 11 so as to permit a batch of freshly formed molding sand to descend from the housing 102 into the casting machine CM as soon as the housing 102 is moved to its (second) position of register of the lower end 4 of the chamber 2 with the aperture 12. In such apparatus, it is not even necessary to move the housing 102 relative to the support 11; all that is necessary is to provide suitable means for shifting the gate 111 (arrow 211) relative to the support 11 and housing 102 as soon as the mixing of a batch of sand and binder material in the chamber 2 is completed.

Figure 6:
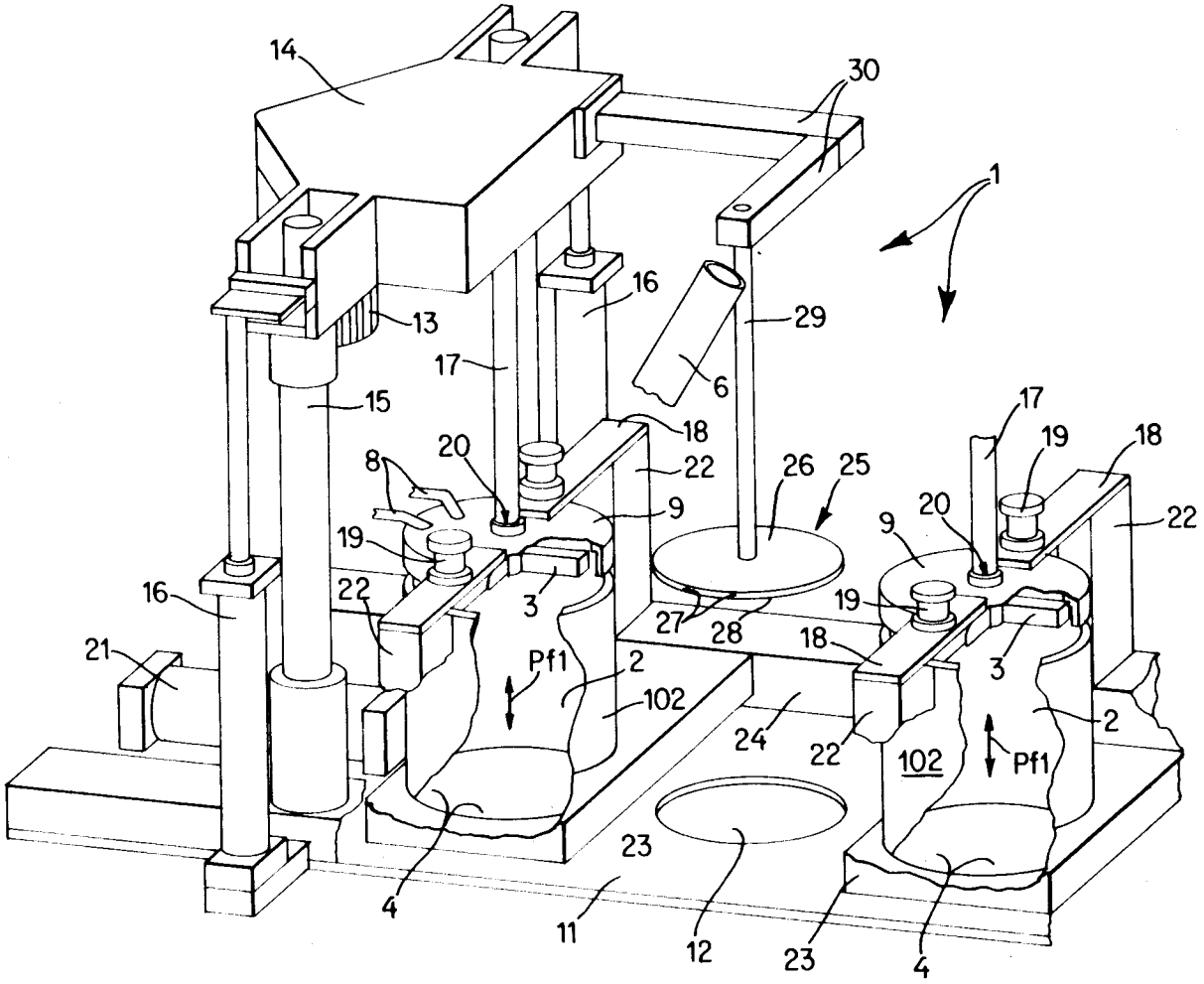
FIG. 6 is a perspective view of a modified apparatus with two housings.

FIG. 6 shows a further modification according to which the support 11 carries a plurality of housings 102 each of which defines a discrete upright cylindrical mixing chamber 2. Each housing 102 is movable toward and away from a (second) position of register of the lower end 4 of the respective mixing chamber 2 with the aperture 12 in the support 11. This renders it possible to supply batches of molding sand at a higher frequency. Of course, the apparatus of FIG. 6 can be modified by providing the support 11 with a discrete aperture 12 for each of the housings 102 so that each chamber 2 can supply batches of molding sand to a separate casting machine. While FIG. 6 merely shows two housings 102, it is equally within the purview of the invention to use a support 11 which carries a total of three or even more housings 102 each of which has its own mixing chamber 2. The provision of several housings 102 renders it possible to form batches of molding sand at a higher frequency because ne of the housings can form a batch while another housing is in the process of discharging its contents into the single aperture 12 or into the respective aperture 12 of the support 11, or that two or more discrete casting machines can receive batches of molding sand at predetermined intervals or in a selected sequence.

In each embodiment of the improved apparatus, the closure 9 for the respective housing 102 is preferably mounted on a holder 18 in such a way that it is movable relative to the holder for the purpose of assuming a first or lower end position in which it bears upon the upper end of the respective housing 102 or upon the mass of flowable material in the respective chamber 2, and a raised position above and away from the respective housing 102 so that the latter can be shifted toward the aperture 12 of the support 11. The lower end portions of the conduits 6 and 8 are movable with the respective closure 9. Each closure 9 has a centrally located passage 20 for a vertical shaft 17 which carries and rotates the respective mixing tool 3. The upper end portion of the shaft 17 is mounted on a plate-like carrier 14 which further supports a motor 13 for the shaft 17. The motor 13 can constitute a variable-speed electric motor which can drive the respective mixing tool 3 at any one of a plurality of different speeds, depending upon the composition of the contents of the respective chamber 2.

The means for moving the closure 9 up and down comprises two fluid-operated motors 19 the cylinders of which are mounted on the holder 18 and the piston rods of which are attached to the closure 9. The stroke of each motor 19 is relatively short, but it must suffice to raise the closure 9 to a level at which the closure cannot interfere with movements of the respective housing 102 toward the position of register of the respective lower end 4 with the aperture 12 and back to the position in which the closure 9 can be lowered to close the upper end of the respective chamber 2.

The means for moving the shaft 17 and the mixing tool 3 at the lower end of such shaft in directions indicated by the arrow Pfl in FIGS. 1 and 2 comprises the aforementioned carrier 14 for the motor 13 and one or more linear motors 16 each of which can constitute a double-acting fluid-operated cylinder and piston unit having a fixed cylinder and a reciprocable piston rod which is attached to the adjacent portion of the carrier 14. The carrier 14 is reciprocable along suitable guide means including two upright columns 15 which can be mounted on the support 11 or on the ground adjacent the support. The columns 15 ensure that the carrier 14 is reciprocable in parallelism with the axis of the respective chamber 2.

The means for controlling the operation of the motors 16 and hence the up-and-down movements of the carrier 14 with the motor 13, shaft 17 and mixing tool 3 is not specifically shown in the drawing. Such means can be programmed to any desired extent. The same applies for the means for operating the motor 21 and the motors 19.

The motors 16 not only reciprocate the mixing tool 3 in the interior of the respective housing 102 but they also serve to lift the mixing tool above the upper end of the housing before the housing is shifted along the support 11 in order to move the open lower end 4 of the respective chamber 2 to a position of register with the aperture 12. The means for transmitting motion from the output element of the motor 13 to the shaft 17 can comprise a belt or chain transmission, a system of gears or any other means which can rotate the shaft 17 and the mixing tool 3 in response to starting of the motor 17. If the output element of the motor 13 rotates at a sufficiently low speed, such output element can constitute or can be directly coupled to the shaft 17. An advantage of mounting the shaft 17 on the carrier 14 is that there is no need to provide a flexible torque-transmitting connection between the output element of this motor and the shaft 17 because the distance between the motor 13 and the shaft 17 remains unchanged.

FIGS. 1 and 2 show an apparatus 1 wherein the carrier 14 is reciprocable along two upright columns 15 and is movable up and down by two linear motors 16. Furthermore, the closure 9 is movable relative to its holder 18 by two motors 19. Such arrangement is preferred at this tim because it reduces the likelihood of jamming of the carrier 14 on the upright guide members 15 and/or of tilting of the closure 9 with reference to the holder 18. The holder 18 has arms 22 (see FIG. 6) which are preferably mounted on the horizontal guides 24 for the pusher 23 of the motor 21 for the housing 102. The arms 22 flank the path of movement of the respective housing 102 between its first position (in which the lower end 4 of the respective mixing chamber 2 is sealed by the upper side of the support 11) and the second position in which the lower end 4 of the respective chamber 2 registers with the aperture 12 of the support 11. As a rule, a single motor 21 suffices to reciprocate the housing 102 between its first and second positions.

The cleaning device 25 for the housing 102 is preferably carried by a bracket 30 which is secured to the carrier 14 for the motor 13 and shaft 17. This ensures that the cleaning device 25 is kept at a fixed distance from the respective closure 9. The illustrated cleaning device 25 comprises two horizontal walls 26 and 28 which define a relatively narrow plenum chamber or gap 27 serving to receive a pressurized fluid (preferably compressed air) by way of a hollow vertical shank 29 which further serves as a means for supporting the walls 26, 28 and for moving such walls up and down in response to upward and downward movements of the carrier 14. That wall (26) which is more distant from the support 11 is preferably dimensioned in such a way that it fits snugly into the respective chamber 2 when the chamber is moved to a position of register with the aperture 12 so that the wall 26 acts not unlike a plunger which sealingly and frictionally engages the internal surface of the housing 102 and predictably removes all traces of sand and/or binder material while the shank 29 moves downwardly toward the aperture 12. At the same time, the plenum chamber 27 discharges compressed air against the internal surface of the housing 102 so that the jets of compressed air contribute to the cleaning action along the internal surface of the housing 102 and to expulsion of all ingredients of the freshly formed batch of molding sand into the casting machine CM. At least the lower wall 28 of the cleaning device 25 can constitute a relatively thin disc.

The cleaning device 25 is lifted to a level above the upper end of the housing 102 while the latter is being advanced by the motor 21 to move the lower end 4 of its chamber 2 into register with the aperture 12 of the support 11. The carrier 14 is then lowered by the motors 16 so as to introduce the cleaning device 25 into the housing 102 whereby the walls 26, 28 and air issuing from the chamber 27 carry out a predictable cleaning action which results in expulsion of all constituents of the freshly formed mixture of molding sand into and beyond the aperture 12. If desired or necessary, the motors 16 can be caused to move the cleaning device 25 repeatedly up and down in the interior of the housing 102 which is held in a position of register with the aperture 12 so as to further enhance the cleaning action. The bracket 30 ensures that the cleaning device 25 is kept at a fixed distance from the closure 9, namely at a distance which corresponds to the distance covered by the respective housing 102 on its way between the first and second positions. The cleaning device 25 is lifted above the upper end of the housing 102 before the motor 21 is actuated again to retract the housing to the position which is shown in FIG. 1.

The combined mechanical and pneumatic cleaning action of the device 25 has been found to be highly satisfactory and to ensure rapid expulsion of all remnants of a freshly formed batch of molding sand through the aperture 12 and into the casting machine CM below the support 11.

It is clear that the apparatus can comprise a separate motor which serves to move the cleaning device 25 up and down. The construction which is shown in the drawing is preferred at this time because the motors 16 can perform several functions of (a) raising and lowering the mixing tool 3 and of (b) raising and lowering the cleaning device 25. The raising and lowering of cleaning device 25 while the mixing tool 3 moves up and down in the respective chamber 2 is of no consequence because the space above the aperture 12 is then unoccupied. It is also within the purview of the invention to provide a separate support for the hollow shank 29 which carries the walls 26 and 28 of the cleaning device 25 and to couple such separate support to the carrier 14 only when it is necessary to move the cleaning device 25 up and down. However, and as mentioned above, the space above the aperture 12 is unoccupied when the housing 102 registers with the closure 9 so that the fact that the cleaning device 25 moves up and down in synchronism with the mixing tool 3 is of no consequence.

The source of compressed air which is connectable or which is permanently connected to the upper end of the hollow shank 29 for the walls 26, 28 or the cleaning device 25 is not shown in the drawing. Such source of compressed air can also be used to convey metered quantities of sand through the conduit 6 as well as to convey metered quantities of one or more binder materials through the respective conduit or conduits 8. Sources of compressed air are invariably available in a casting plant so that it is not necessary to establish a separate source for admission of compressed air into the shank 29. The pressure of compressed air in the plenum chamber 27 can be regulated by a suitable throttling device (e.g., a valve) so as to ensure that the jet or jets of compressed air which issue from the chamber 27 impinge upon the internal surface of the respective housing 102 with a force which suffices to ensure predictable propulsion of all fragments that have adhered to the housing into the aperture 12 below the respective chamber 2. The force with which the jet or jets of compressed air remove fragments of material from the internal surface of the housing 102 can be further regulated by selecting the width of the plenum chamber 27. To this end, one of the walls 26, 28 can be moved toward or away from the other wall in a manner which is not specifically shown in the drawing.

It is also possible to disconnect the upper end of the shank 29 from the source of compressed air or another gaseous fluid if the mechanical cleaning action of the upper wall 26 suffices to remove all traces of sand and/or binder material which happen to adhere to the internal surface of the respective housing 102. If desired, the upper wall 26 can carry a marginal sealing element in the form of a bead which is made of rubber or the like and which slides along the internal surface of the housing 102 in the course of a cleaning operation. Such sealing device ensures that compressed air which is discharged by the plenum chamber 27 cannot flow upwardly but is compelled to flow downwardly and to expel removed fragments of sand and/or binder material into the aperture 12 of the support 11.

Figure 7:
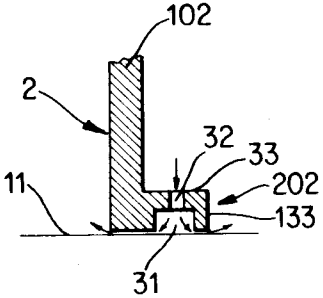
FIG. 7 is an enlarged view of a detail within the phantom-line circle in FIG. 2, showing the manner in which the upper side of the support for the housing can be kept clean by one or more streams of a pressurized fluid.

FIG. 7 shows that the lower end portion of the housing 102 can be provided with a flange 202 the underside of which is formed with a groove 31 which is open toward the upper side of the support 11. The groove 31 can receive compressed air by way of one or more ports 32 which are provided in the upper side 33 of the flange 202 and/or in the peripheral surface 133 of the flange. The port or ports 32 can be connected to that source which supplies compressed air to the interior of the shank 29 of the cleaning device 25. The purpose of compressed air which issues from the groove 31 and flows along the underside of the flange 202 is to clean the support 11 and to thus reduce friction between the housing 102 and the support while the housing is being moved toward or away from the position of register with the aperture 12. The port or ports 32 can admit compressed air at all times or at least while the housing 102 is caused to move with reference to the support 11. The stream or streams of compressed air which issue from the groove 31 reduce the likelihood of escape of molding sand from the chamber 2 while the housing 102 advances toward the position of register with the aperture 12 of the support 11. This ensures that the entire batch of freshly formed molding sand can be discharged into the casting machine CM. The flange 202 and its groove 31 constitute an optional but advantageous and desirable feature of the housing 102.

The diameter of the flange 202 is preferably selected in such a way that it fits snugly between the guide means 24 for the housing 102. The pusher 23 of the motor 21 can engage the housing 102 at a level above or below the flange 202.

An important advantage of the improved apparatus is that the mixing operation can be completed within a short interval of time as well as that each and every portion of a freshly formed batch of molding sand has the same composition. In other words, the homogeneity of each and every portion of a freshly formed batch is constant and predictable. This is attributable to the fact that the mixing tool 3 not only rotates about its axis but also moves axially of the chamber 2 between the two ends of the respective housing 102 so as to ensure that each and every portion of the supply of flowable material in the chamber is mixed and homogenized to the same extent. The dimensions of the housing 102 and mixing tool 3 can be readily selected in such a way that the housing does not exhibit any dead corners which could not be reached by the blade or blades of the mixing tool. The mixing and homogenizing action is especially satisfactory if the mixing tool 3 is caused to repeatedly move axially of the chamber 2 between the upper and lower ends of the respective housing 102. The mixing action is enhanced due to the fact that the mixing tool 3 rotates about its axis while moving axially between the upper and lower ends of the housing 102.

As mentioned above, the axis of the mixing chamber 2 need not necessarily be vertical. However the utilization of one or more housings 102 with upright mixing chambers is preferred at this time because the contents of such chamber or chambers can be readily evacuated, primarily by gravity flow, by the simple expedient of moving the lower ends 4 of the chambers 2 into register with the aperture or with the respective apertures 12 of the support 11 and/or vice versa or by withdrawing the gate 111 when the making of a batch of molding sand is completed. The utilization of a relatively short mixing tool 3, or of two or more relatively short mixing tools in axial alignment with one another, also contributes to a satisfactory mixing and homogenizing action.

While it is also possible to employ a relatively short mixing chamber having a height which need not exceed its diameter, the utilization of a relatively tall mixing chamber is preferred at this time because a relatively large quantity of sand and binder material can be thoroughly mixed even though the diameter of the chamber 2 is relatively small. All that is necessary is to increase the stroke of the shaft 17 in order to make sure that the mixing tool 3 will move all the way between the open lower end 4 and the inlet at the upper end of the respective mixing chamber 2. The utilization of a relatively small-diameter mixing tool 3 in a tall mixing chamber 2 has been found to be more satisfactory than the utilization of a larger-diameter mixing tool in a shorter chamber. Moreover, the energy requirements of a motor which rotates a small-diameter mixing tool are considerably lower than those of a motor which must rotate a larger-diameter mixing tool.

The provision of a closure 9 which carries the discharge ends of the conduits 6 and 8 is desirable and advantageous because the discharge ends of such conduits need not be disconnected from their support upon completion of a mixing operation and preparatory to movement of the housing to the position of register of the lower end 4 of its chamber 2 with the aperture 12 of the support 11.

Though it is possible to admit first a metered quantity of sand and thereupon metered quantities of binder material or vice versa, it is presently preferred to admit sand and binder material simultaneously so that the binder material forms one or more columns in the mass of sand which substantially or completely fills the respective mixing chamber 2. This ensures a distribution of all constituents of molding sand in equal proportions at different levels of the chamber 2 so that the mixing and homogenizing action of the tool 3 is simplified and facilitated. Moreover, such mode of admitting metered quantities of sand and binder material renders it possible to complete the mixing and homogenizing operation within a short interval of time. The mixing tool is merely required to mix preselected percentages of sand and binder material at different levels in the interior of the respective housing 102 and, for good measure, to also effect a predictable and intensive intermixing in the axial direction of the chamber as indicated by the double-headed arrow Pfl. The provision of conduits 6 and 8 which carry nozzles for spraying or similar distribution of the respective constituents of molding sand also contributes to a more satisfactory mixing action and to a shortening of the mixing and homogenizing time. A nozzle 10 can be provided at the discharge end of each conduit and preferably at least at the discharge end of each conduit 8. In other words, nozzles can be used for spraying of pulverulent solid material as well as for spraying of liquid or liquefied constituents. It has been found that the utilization of one or more nozzles contributes to thorough intermixing of sand with one or more binder materials already during admission of sand into the interior of the respective housing 102, i.e., prior to start or the actual mixing and homogenizing action. Each nozzle can be used to spray the respective binder material across the entire chamber 2 or only in the neighboring upright column of sand in the housing 102.

Preliminary mixing of sand with one or more binder materials is especially desirable and advantageous because, as a rule, sand constitutes the major percentage of material which fills a chamber 2 prior to start of the actual mixing operation with one or more mixing tools. Therefore, at least some preliminary mixing of sand with the admitted binder material or materials contributes significantly to a shortening of the mixing and homogenizing time as well as higher quality of the ultimate product. In accordance with heretofore known procedures, intensive mixing of sand with relatively small quantities of binder material can be achieved only by unduly prolonging the mixing operation and/or by admitting excessive quantities of binder material well beyond those quantities which are necessary for the making of molding sand having the required optimum composition. The admission of excessive quantities of binder material was considered necessary to ensure that each and every portion of a batch of molding sand would contain the minimum required quantity of binder material.

While it is also possible to mount each housing 102 in a fixed position with reference to the support 11 and/or gate 111, the provision of means for moving the housing or housings relative to the support is preferred at this time because this renders it possible to evacuate the entire contents of a chamber 2 in a time-saving operation and without leaving any, or practically any, remnants in the chamber so that each freshly formed batch contains a predictable quantity of each selected ingredient. Losses of forming sand during shifting of the housing 102 relative to the support 11 can be reduced to a minimum by the provision of the feature (groove 31) which is shown in FIG. 7. In addition, the finish of the upper side of the support 11 and of the underside of each housing 102 can be readily selected in such a way that hardly any molding sand can escape even if the groove 31 is omitted. Losses in molding sand are reduced still further if the apparatus employs a gate 111 for each housing 102 so that the housing need not be shifted relative to its support.

A further important advantage of the improved apparatus is that it can employ one or more relatively simple and inexpensive mixing tools. Since the wear on such tools is pronounced, regardless of the construction of the apparatus, the utilization of relatively simple and lightweight as well as inexpensive tools reduces the maintenance cost of the machine because even frequent interchanges of tools do not unduly increase the cost of operation. Moreover, a relatively small and lightweight mixing tool can be rapidly attached to or detached from the respective shaft 17.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for mixing sand with flowable binder material, such as clayey matter, pulverized wood, pulverulent iron oxide and the like, for the making of molding sand, comprising a housing defining a substantially cylindrical mixing chamber; means for admitting into the chamber metered quantities of sand and binder material; and means for mixing the contents of the chamber, including at least one mixing tool operative to mix the contents at least substantially over the entire cross-section of the chamber, and means for moving the mixing tool at least once in the axial direction of the chamber.

2. The apparatus of claim 1, wherein said mixing means further comprises means for rotating said tool while the tool is moved in the axial direction of the chamber.

3. The apparatus of claim 1, wherein the axis of said chamber is substantially vertical.

4. The apparatus of claim 1, wherein the length of said tool in the axial direction of said chamber is less than the axial length of the chamber.

5. The apparatus of claim 1, wherein the axial length of said chamber equals or exceeds the diameter of the chamber.

6. The apparatus of claim 1, wherein said housing comprises a closure for said chamber and said admitting means has outlets in said closure.

7. The apparatus of claim 6, wherein said chamber has a substantially vertical axis and said closure is disposed above said chamber.

8. The apparatus of claim 1, wherein said admitting means includes means for supplying sand simultaneously with binder material.

9. The apparatus of claim 8, wherein said admitting means has a plurality of outlets which are spaced apart from one another in the circumferential direction of said chamber.

10. The apparatus of claim 9, wherein said outlets are arranged to admit sand and binder material substantially in parallelism with the axis of the chamber.

11. The apparatus of claim 1, wherein the means for admitting binder material includes at least one nozzle for admission of a jet of respective binder material into said chamber.

12. The apparatus of claim 11, wherein said nozzle is a spray nozzle.

13. The apparatus of claim 1, wherein said tool comprises at least one rotary blade.

14. The apparatus of claim 1, wherein said chamber has an open lower end and further comprising a support for said housing, said support having an aperture and said housing being movable with reference to said support between at least one first position in which the support at least substantially seals the lower end of said chamber and a second position in which the lower end of the chamber registers with said aperture so that the intermixed contents of the chamber can be evacuated by way of said lower end and said aperture.

15. The apparatus of claim 14, wherein the area of said aperture at least equals the area of the lower end of said chamber.

16. The apparatus of claim 14, wherein the area of the open end of said chamber matches the area of any other part of said chamber.

17. The apparatus of claim 14 for supplying molding sand to a casting machine, wherein said aperture is disposed above the casting machine.

18. The apparatus of claim 14, further comprising at least one second housing on said support, said second housing having a second mixing chamber with an open lower end and said second housing being movable with reference to said support between at least one first position in which the support at least substantially seals the lower end of said second chamber and a second position in which the lower end of said second chamber registers with said aperture.

19. The apparatus of claim 14, wherein the axis of said chamber is substantially vertical and said admitting means is disposed above said chamber, and further comprising elevator means for lifting and lowering said admitting means with reference to said housing so that the admitting means can be lifted preparatory to movement of said housing to said second position.

20. The apparatus of claim 19, wherein said elevator means comprises a carrier for said tool and said admitting means, and motor means for moving said carrier up and down.

21. The apparatus of claim 20, wherein said tool includes at least one rotary blade and further comprising means for rotating said blade, said rotating means being mounted on said carrier.

22. The apparatus of claim 20, further comprising guide means for said carrier, said means for moving said carrier up and down including at least one linear motor for reciprocating said carrier along said guide means.

23. The apparatus of claim 22, wherein said guide means includes means for confining said carrier to reciprocatory movements in parallelism with the axis of said chamber.

24. The apparatus of claim 1, wherein said chamber has an open lower end and further comprising a gate movable between a first position in which the gate at least substantially seals said lower end and a second position in which the gate permits evacuation of the contents of said chamber by way of said lower end.

25. The apparatus of claim 24, further comprising a support for said housing, said support having an aperture in register with the lower end of said chamber and said gate being disposed between said housing and said support in the first position thereof.

26. The apparatus of claim 1, wherein said chamber has an open lower end and further comprising a support for said housing, said support having an aperture and said housing being movable with reference to said housing between at least one first position in which said support at least substantially seals said lower end and a second position in which said aperture registers with said lower end so that the intermixed contents of said chamber can be evacuated by way of said lower end and said aperture, said housing including a portion surrounding said lower end and having at least one groove which is open adjacent said support, and further comprising means for introducing into said groove a pressurized fluid at least while said housing is moved with reference to said support.

27. The apparatus of claim 26, wherein said portion includes a flange having an underside which is provided with said groove and a second side, said introducing means including at least one port provided in said second side and communicating with said groove.

28. The apparatus of claim 1, wherein said housing includes a detachable closure for said chamber and said admitting means has outlets in said closure, and further comprising a holder for said closure and means for moving said closure with reference to said holder between a first position in which said closure overlies said chamber and is biased against said housing and a second position in which the closure is spaced apart from said chamber.

29. The apparatus of claim 28, further comprising means for moving said housing with reference to said holder to and from a predetermined position in which the intermixed contents of the chamber can be evacuated from the housing.

30. The apparatus of claim 29, wherein said housing is movable along a predetermined path and said holder comprises arms flanking said path.

31. The apparatus of claim 30, further comprising guide means defining said path, said arms being provided on said guide means and said means for moving the housing including a pusher which is connected with said housing.

32. The apparatus of claim 31, wherein said chamber has a lower end which is exposed for evacuation of the contents of said chamber in said predetermined position of said housing and said pusher at least partially surrounds said housing in the region of said lower end.

33. The apparatus of claim 1, further comprising means for mechanically cleaning said chamber.

34. The apparatus of claim 33, wherein said housing is movable to and from a predetermined position for evacuation of the intermixed contents of its chamber, said cleaning means including means for cleaning said chamber in said predetermined position of said housing.

35. The apparatus of claim 33, wherein said chamber has an inlet at one axial end thereof and said cleaning means includes a cleaning implement and means for moving said implement axially of said chamber into and from said housing by way of said inlet.

36. The apparatus of claim 35, wherein the axis of said chamber is substantially vertical and said inlet is located at the upper end of said chamber, said cleaning implement being movable to and from an idle position at a level above said inlet.

37. The apparatus of claim 36, wherein said chamber has an open lower end and further comprising a support for said housing, said support having an aperture and said housing being movable with reference to said support between said predetermined position in which the lower end of said chamber registers with said aperture to permit for evacuation of intermixed contents of said chamber by way of said aperture and at least one second position in which said support at least substantially seals said lower end, and further comprising means for moving said implement up and down out of and into said chamber in the predetermined position of said housing.

38. The apparatus of claim 33, wherein said cleaning means comprises a substantially circular cleaning implement having a diameter which equals or approximates the diameter of said chamber and means for moving said implement axially into and from said chamber, said housing having an inlet for admission of said implement.

39. The apparatus of claim 38, further comprising means for moving said implement relative to said housing and means for moving said housing with reference to said implement to and from a predetermined position in which the intermixed contents of said chamber are evacuated from said housing.

40. The apparatus of claim 33, further comprising a support for said housing, means for moving said housing with reference to said support between at least one first position in which said chamber receives sand and binder material and a second position in which the intermixed contents of the chamber are ready for evacuation from said housing, a carrier for said tool, and means for securing said cleaning means to said carrier.

41. The apparatus of claim 33, wherein said cleaning means includes a cleaning implement and means for moving said cleaning implement into and from said housing in the axial direction of said chamber, said implement comprising two spaced-apart walls defining a plenum chamber and said cleaning means further including means for conveying into said plenum chamber a compressed gaseous fluid which is discharged into the chamber of said housing during movement of said implement in said housing.

42. The apparatus of claim 41, wherein at least one of said walls includes a disc and said plenum chamber is open along the internal surface of said housing so that the gaseous fluid impinges upon such internal surface while the implement is moved in the housing axially of the chamber in said housing.

43. The apparatus of claim 41, wherein said conveying means comprises an elongated hollow shaft and said walls are mounted on said shaft, said shaft forming part of means for moving said implement with reference to said housing.

44. The apparatus of claim 41, wherein said housing has an inlet for said implement at one axial end of said first named chamber and an outlet for evacuation of intermixed contents of said housing at the other axial end of said first named chamber, one of said walls being nearer to and the other of said walls being more distant from said outlet, said other wall including a plunger which is in frictional engagement with the internal surface of said housing during movement of said implement in and relative to said housing.

45. The apparatus of claim 44, further comprising a support for said housing, said support having an aperture and said housing being movable with reference to said support between at least one first position in which the support seals said outlet and a second position in which the outlet registers with said aperture so that the contents of said first named chamber can be evacuated by way of said aperture, and further comprising a carrier for said mixing tool, said cleaning means being mounted on said carrier so that said conveying means is disposed at a level above and in register with said aperture.

46. The apparatus of claim 45, further comprising means for securing said cleaning means to said carrier.

47. Apparatus for mixing sand with flowable binder material, such as clayey matter, pulverized wood, pulverulent iron oxide and the like, for the making of molding sand, comprising a housing defining a substantially cylindrical mixing chamber; a support for said housing; means for admitting into said chamber metered quantities of sand and binder material; means for mixing the contents of the chamber, including at least one mixing tool operative to mix the contents at least substantially over the entire cross-section of the chamber, and means for moving the mixing tool at least once in the axial direction of said chamber; means for moving said housing with reference to said support between at least one first position in which said chamber receives sand and binder material and a second position in which the intermixed contents of the chamber are ready for evacuation from said housing, said housing being arranged to cover a predetermined distance during movement between said first and second positions; a carrier for said tool; means for cleaning said chamber; and means for securing said cleaning means to said carrier; said cleaning means being spaced apart from said tool a distance which matches said predetermined distance.

* * * * *